US007510382B2

(12) United States Patent
Jeong

(10) Patent No.: US 7,510,382 B2
(45) Date of Patent: Mar. 31, 2009

(54) APPARATUS FOR PREVENTING OVERHEATING OF SCROLL COMPRESSOR

(75) Inventor: Chan-Hwa Jeong, Gimhae (KR)

(73) Assignee: LG Electronics Inc., Seoul (KR)

( * ) Notice: Subject to any disclaimer, the term of this patent is extended or adjusted under 35 U.S.C. 154(b) by 281 days.

(21) Appl. No.: 11/092,661

(22) Filed: Mar. 30, 2005

(65) Prior Publication Data

US 2005/0220654 A1 Oct. 6, 2005

(30) Foreign Application Priority Data

Mar. 31, 2004 (KR) ..... 10-2004-0022438

(51) Int. Cl.
*F01C 21/04* (2006.01)
*F01C 21/06* (2006.01)

(52) U.S. Cl. ..... 418/86; 418/55.1

(58) Field of Classification Search ..... 417/228, 417/243, 438; 418/55.1–55.6
See application file for complete search history.

(56) References Cited

U.S. PATENT DOCUMENTS 5,607,288 A * 3/1997 Wallis et al. ..... 417/310
5,640,854 A * 6/1997 Fogt et al. ..... 62/197
5,707,210 A * 1/1998 Ramsey et al. ..... 417/32
6,390,072 B1 * 5/2002 Breeden ..... 123/509
6,575,707 B2 * 6/2003 Matt et al. ..... 417/228

* cited by examiner

*Primary Examiner*—Thomas Denion
*Assistant Examiner*—Douglas J. Duff
(74) *Attorney, Agent, or Firm*—Birch, Stewart, Kolasch & Birch, LLP

(57) ABSTRACT

Provided is an apparatus for preventing overheating of a scroll compressor including a first connection flow path for communicating a high pressure space and a low pressure space in a casing, a second connection flow path for communicating the first connection flow path and the low pressure space in the casing, a fluid refrigerant inflow guide pipe for guiding a fluid refrigerant from a refrigeration cycle system to flow into the low pressure space via the second connection flow path by connecting one side of the refrigeration cycle system with the second connection flow path, and a second connection flow path valve coupled to an inside of the first connection flow path, for opening/closing the second connection flow path according to a pressure difference between the low pressure space and the high pressure space, and a temperature sensing type valve coupled to an inside of the first connection flow path, for opening/closing the first connection flow path according to a temperature of the high pressure space, whereby the high temperature portion of the compressor is advantageously prevented from being overheated above a designated temperature while the compressor operates, and also manufacturing costs therefor are reduced.

12 Claims, 4 Drawing Sheets

APPARATUS FOR PREVENTING OVERHEATING OF SCROLL COMPRESSOR

BACKGROUND OF THE INVENTION

1. Field of the Invention

The present invention relates to a scroll compressor, and particularly, to an apparatus for preventing overheating of a scroll compressor by which a high temperature portion of a compressor is prevented from being overheated above a designated temperature while driving and a construction thereof can be made more simple.

2. Description of the Background Art

In general, a refrigeration cycle system, as shown in FIG. 1, includes a compressor 1 for compressing a refrigerant, a condenser 2 for discharging heat to the exterior by condensing the refrigerant compressed in the compressor 1, an expansion valve 3 for lowering a pressure of the refrigerant condensed in the condenser 2, and an evaporator 4 for absorbing external heat by evaporating the refrigerant which has been passed through the expansion valve 3.

The compressor 1, the condenser 2, the expansion valve 3 and the evaporator 4 are connected all together by connection pipes 5 to form one cycle (a closed system).

The refrigeration cycle system is operated as follows.

First, when power is applied to the refrigeration cycle system, the compressor 1 begins its operation, and accordingly the refrigerant is compressed in the compressor 1 to be in a state of high temperature and high pressure and then discharged. The refrigerant in a gaseous state of high temperature and high pressure which has been discharged out of the compressor 1 then flows into the condenser 2, and is condensed as it discharges heat to the exterior while it flows through the condenser 2. As a result, the refrigerant is condensed into a fluid form. The refrigerant in the fluid state having passed through the condenser 2 goes through the expansion valve 3 and thus its pressure is lowered. The condensed refrigerant in the low pressure state flows into the evaporator 4, and then is evaporated into a gaseous state, as the refrigerant in the evaporator 4 absorbs external heat. The gaseous refrigerant at high temperature and high pressure having passed through the evaporator 4 flows into the compressor 1 again.

By repeating those procedures continuously, heat is discharged from condenser 2 to the outside, and the temperature is lowered in the evaporator 4.

Such refrigeration cycle system is typically mounted in an air-conditioner, a refrigerator, a showcase cooler and the like. The air-conditioner selectively transfers the heat generated in the condenser 2 to the exterior and extracts heat from an indoor area into the evaporator 4, and maintains a comfortable indoor state.

The compressor 1 constructing the refrigeration cycle system converts electrical energy into kinetic energy and compresses the refrigerant by the kinetic energy. As the compressor 1 is one of main components for the refrigeration cycle system, there are various types of compressors such as a rotary compressor, a scroll compressor, a reciprocal compressor, and the like.

The scroll compressor and the rotary compressor are generally used in the air-conditioner.

Scroll compressors are classified into a high pressure type and a low pressure type according to the state of pressure in a casing. In the high pressure type scroll compressor, the refrigerant directly flows in a gap between a fixed scroll and an orbiting scroll, and the refrigerant at high temperature and high pressure compressed between the fixed scroll and the orbiting scroll is discharged toward the condenser via an inside of the casing and a discharge pipe. As a result, the inside of the casing is always maintained in a state of high temperature and high pressure while the compressor operates.

In the low pressure scroll compressor, the refrigerant flows into the casing and is sucked into the gap between the fixed scroll and the orbiting scroll. The refrigerant at high temperature and high pressure compressed between the fixed scroll and the orbiting scroll is discharged toward the condenser via a high temperature and high pressure portion mounted on one side of the casing and the discharge pipe. As a result, the inside of the casing is always maintained in a state of low pressure while the compressor operates.

In designing the compressor, on the other hand, a high pressure portion of the compressor is designed to maintain a temperature within a range of a designated value in a state of a normal operation of the refrigeration cycle system. The temperature of the high pressure portion of the compressor is one of main design considerations. Accordingly, maintaining the high pressure portion of the compressor to be within the designated temperature range while operating has influences upon the capability, efficiency and reliability of the compressor, and also upon the capability and efficiency of the refrigeration cycle system having the compressor therein.

Therefore, the compressor is designed to have the high pressure portion operate within the designated temperature range.

However, an air-conditioner having the compressor therein is used in various different circumstances. Accordingly, when components of the air-conditioner are not allowed to properly perform their functions, the temperature of the high pressure portion of the compressor may be maintained at over the designated temperature whereby a life span of the compressor may disadvantageously be shortened, and breakdown thereof may be caused.

In order to solve such problem, when the temperature of the high pressure portion of the compressor is sensed and it is determined to be over the range of the designated temperature, fluid refrigerant is supplied toward the high pressure portion of the compressor to cool the high pressure portion of the compressor. As a result, the high pressure portion of the compressor is maintained within the range of the designated temperature.

However, for this method, a temperature sensor for sensing the temperature and a circuit for controlling a valve which controls injection of the fluid refrigerant are needed. As a result, a construction of the compressor may become complicated and the manufacturing cost thereof may be highly increased.

SUMMARY OF THE INVENTION

Therefore, an object of the present invention is to provide an apparatus for preventing overheating of a scroll compressor by which a high temperature portion of the compressor can be prevented from being overheated over a designated temperature while the compressor operates.

According to another object of the present invention, there is provided an apparatus for preventing overheating of a scroll compressor which is capable of simplifying a construction of the compressor.

To achieve these and other advantages and in accordance with the purpose of the present invention, as embodied and broadly described herein, there is provided an apparatus for preventing overheating of a scroll compressor in which an orbiting scroll engaging with a fixed scroll in a casing makes an orbiting movement to compress a gas, the apparatus comprising: a first connection flow path for communicating a high pressure space and a low pressure space in the casing, a second connection flow path for communicating the first connection flow path and the low pressure space in the casing, a fluid refrigerant inflow guide pipe for guiding a fluid refrigerant of a refrigeration cycle system to flow into the low pressure space via the second connection flow path by connecting one side of the refrigeration cycle system with the second connection flow path, a second connection flow path valve coupled to an inside of the first connection flow path, for opening/closing the second connection flow path in accordance with a pressure difference between the low pressure space and the high pressure space, and a temperature sensing type valve coupled to an inside of the first connection flow path, for opening/closing the first connection flow path according to a temperature of the high pressure space.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate the invention and together with the description serve to explain the principles of the invention.

In the drawings.

DETAILED DESCRIPTION OF THE PREFERRED EMBODIMENTS

Description will now be given in detail of the present invention, examples of which are illustrated in the accompanying drawings.

The apparatus for preventing overheating of a scroll compressor according to the present invention will now be described in detail with reference to the accompanying drawings.

Figure 1:
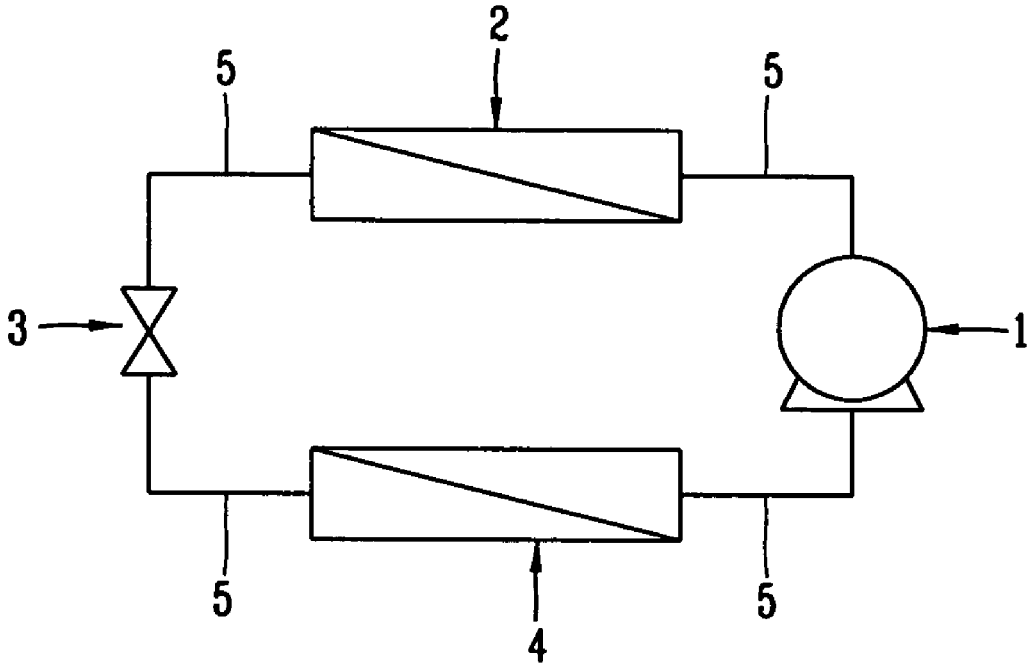
FIG. 1 BACKGROUND ART
FIG. 1 is a schematic piping diagram showing a general refrigeration cycle system.
Figure 2:
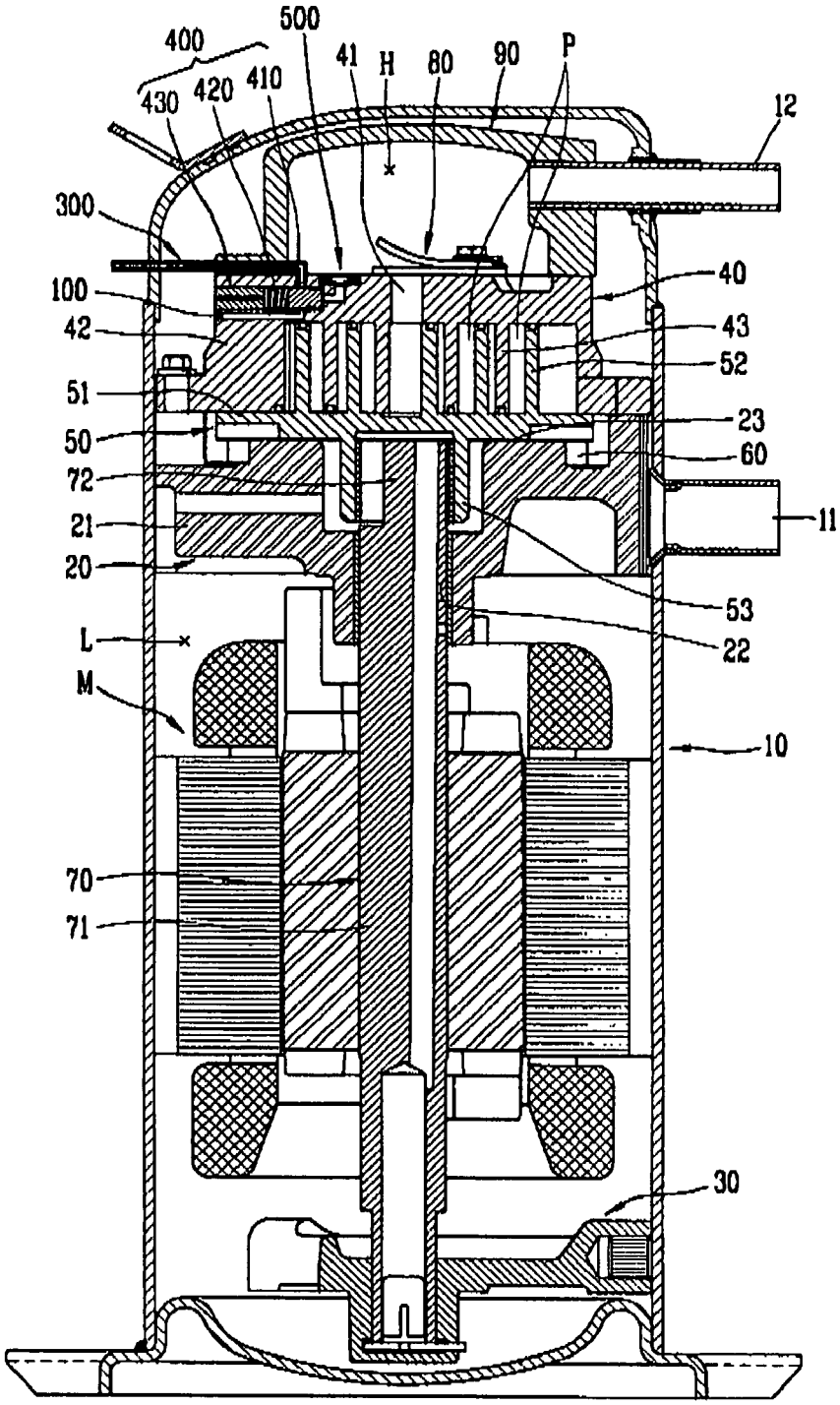
FIG. 2 is a cross-sectional view of a scroll compressor equipped with an apparatus for preventing overheating in accordance with the present invention.
Figure 3:
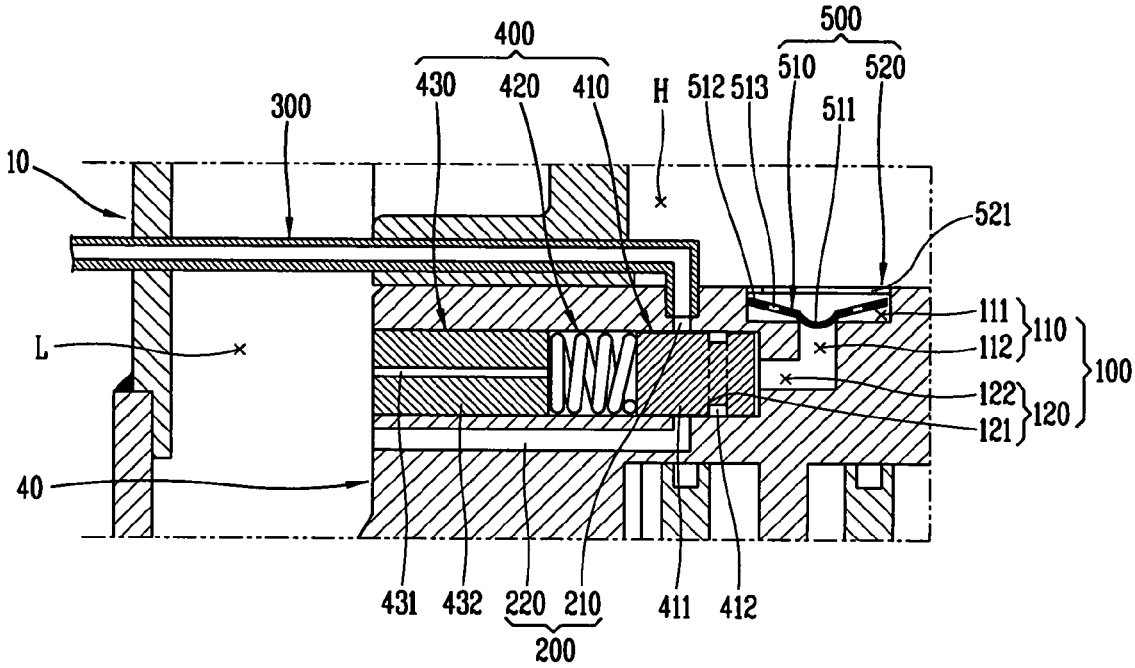
FIG. 3 is a cross-sectional view of the apparatus for preventing overheating of a scroll compressor in accordance with the present invention.

FIG. 2 is a cross-sectional view showing a scroll compressor equipped with an apparatus for preventing overheating in accordance with the present invention and FIG. 3 is a cross-sectional view showing the apparatus for preventing overheating of a scroll compressor in accordance with the present invention.

Referring to the drawings, the scroll compressor includes a casing 10, a main frame 20 and a sub frame 30 fixedly-coupled with a certain interval therebetween in the casing 10; a fixed scroll 40 fixedly-coupled to the casing 10 so as to be positioned at an outer side of the main frame 20, an orbiting scroll 50 positioned between the fixed scroll 40 and the main frame 20 so as to be engaged with the fixed scroll 40 for orbiting movement relative thereto; an Oldham ring 60 positioned between the orbiting scroll 50 and the main frame 20, for preventing a rotation of the orbiting scroll 50, a driving motor M fixedly-coupled to the casing 10 so as to be positioned between the main frame 20 and the sub frame 30, for generating a driving force, a rotating shaft 70 for transferring the driving force of the driving motor M to the orbiting scroll 50, a valve assembly 80 mounted on an outer surface of the fixed scroll 40, and a cover 90 fixedly-coupled to the outer surface of the fixed scroll 40 and into which a refrigerant at high temperature and high pressure discharged through a discharge hole 41 of the fixed scroll 40 may flow from the valve assembly 80.

A suction pipe 11 into which a refrigerant is sucked is coupled to a side of the casing 10, and a discharge pipe 12 through which the refrigerant is discharged penetrates the casing 10 and is coupled into the cover 90 to be communicated with the inside of the cover 90.

The main frame 20 includes a frame body 21 formed with a shaft insertion opening 22 penetrating therethrough and through which the rotating shaft 70 is inserted, and a bearing surface 23 formed on an outer face of the frame body 21 and supporting the orbiting scroll 50.

The fixed scroll 40 includes a body portion 42 having the discharge hole 41 through the middle thereof, a wrap 43 formed in an involute shape (with a certain thickness and height) on one surface of the body portion 42, and an inlet (not shown) formed at one side of the body portion 42.

The orbiting scroll 50 includes a circular plate portion 51, a wrap 52 formed in an involute shape (having a certain thickness and height) at one surface of the circular plate portion 51, and a boss portion 53 protrusively-formed in the middle of the other side of the circular plate portion 51 and coupled to the rotating shaft 70.

The orbiting scroll 50 is coupled between the fixed scroll 40 and the main frame 20 such that the wrap 52 of the orbiting scroll 50 is engaged with the wrap 43 of the fixed scroll 40, and an outer surface of the circular plate portion 51 is positioned on the bearing surface 23 of the main frame 20.

The rotating shaft 70 includes a shaft portion 71 and an eccentric portion 72 extendedly-formed at one end of the shaft portion 71 so as to be eccentric relative to the center line of the shaft portion 71.

The shaft portion 71 of the rotating shaft 70 is fixedly-coupled to the driving motor M and inserted through the shaft insertion opening 21 in the main frame 20. The eccentric portion 72 of the rotating shaft 70 is inserted into the boss portion 53 of the orbiting scroll 50.

The inside of the cover 90 encloses a high pressure space H together with an outer surface of the fixed scroll 10.

The inside of the casing 10 except for the inside of the cover 90 encloses a low pressure space L in which a gaseous refrigerant sucked into the casing 10 is filled.

Furthermore, as shown more clearly in FIG. 3, the apparatus for preventing overheating includes a first connection flow path 100 for communicating the high pressure space H with the low pressure space L in the casing 10, a second connection flow path 200 for communicating the first connection flow path 100 with the low pressure space L in the casing 10, a fluid refrigerant inflow guide pipe 300 for guiding fluid refrigerant from a refrigeration cycle system to flow into the low pressure space L via the second connection flow path 200 by connecting one side of the refrigeration cycle system with the second connection flow path 200, a second connection flow path valve 400 coupled to an inside of the first connection flow path, for opening/closing the second connection flow path 200 in accordance with a pressure difference between the low pressure space L and the high pressure space H, and a temperature sensing type valve 500 coupled to an inside of the first connection flow path 100, for opening/closing the first connection flow path 100 according to a temperature of the high pressure space H.

The first connection flow path 100 communicates the high pressure space H at an outer surface of the fixed scroll 40 and the low pressure space L at a side surface of the fixed scroll 40. For instance, the first connection flow path 100 includes a first passage 110 extending inwardly from the outer surface of the fixed scroll 40 located in the high pressure space H, and a second passage 120 for communicating the side surface of the fixed scroll 40 located in the low pressure space L and the first passage 110. The first passage 110 is preferably perpendicular to the second passage 120.

The first passage 110 includes an installation bore 111 recessed into the outer surface of the fixed scroll 40 with a certain inside diameter, and a first hole 112 formed with an inside diameter smaller than that of the installation bore 111, extending inwardly from the installation bore 111 and connected to the second passage 120. The second passage 120 includes a cylindrical coupling bore 121 extending inwardly from a side surface of the fixed scroll 40 with a certain inside diameter and depth, and a second hole 122 formed with an inside diameter smaller than that of the coupling bore 121, extending inwardly from the coupling bore 121, and connected to the first passage 120.

The second connection flow path 200 includes a third passage 210 formed in the fixed scroll 40 and intersecting with the first connection flow path 100, and a fourth passage 220 formed in the fixed scroll 40, for communicating a side surface of the fixed scroll 40 and the third passage 210. The third passage 210 is formed with a certain depth to be communicated with the coupling bore 121 of the second passage 120 in a perpendicular direction to the outer surface of the fixed scroll 40. The fourth passage 220 is formed with a certain depth to be connected to the third passage 210 at the side surface of the fixed scroll 40. The third passage 210 is preferably formed to intersect with the coupling bore 121 perpendicularly. In addition, the third passage 210 is preferably formed to be perpendicular to the fourth passage 220.

The fluid refrigerant inflow guide pipe 300 is formed (as a curved pipe) having a certain length. One end of the fluid refrigerant inflow guide pipe 300 is connected to a connection pipe for being connected to the condenser and the expansion valve of the refrigeration cycle system, while the other end thereof is connected to the third passage 210 of the second connection flow path 200. The refrigeration cycle system is composed of the scroll compressor, the condenser, the expansion valve and an evaporator, each of which is connected by connection pipes to form a cycle (a closed system).

The second connection flow path valve 400 includes a valve spool 410 inserted into the coupling bore 121 of the first connection flow path 100, for opening/closing the second connection flow path 200 by being reciprocally slid within a certain distance, a spring 420 inserted into the coupling bore 121 of the first connection flow path 100 behind the valve spool 410, for urging the valve spool 410 towards the second hole 122, and a supporting member 430 having a through hole 431 therethrough and press-fitted in the coupling bore 121 of the first connection flow path 100 behind the spring 420, for supporting the spring 420.

The valve spool 410 is composed of a cylindrical body 411 formed with a certain length and an outside diameter corresponding to the inside diameter of the coupling bore 121 of the first connection flow path 100, and an annular groove 412 formed in an outer circumferential surface of the cylindrical body 411 with a certain width and depth. The valve spool 410 is slidable in the coupling bore 121 of the first connection flow path 100.

The spring 420 is preferably a compression coil spring. The spring 420 is inserted into the coupling bore 121 of the first connection flow path 100 behind the valve spool 410.

The supporting member 430 has a certain length and outside diameter and is composed of a cylindrical body 432 having a through hole 431 therein. The supporting member 430 is press-fitted in the coupling bore 121 of the first connection flow path 100 behind the spring 420, thereby supporting the spring 420.

The temperature sensing type valve 500 includes a diaphragm valve plate 510 inserted into the installation bore 111 of the first connection flow path 100 and capable of changing its shape according to the temperature of the high pressure space H and thus opening/closing the first connection flow path 100, and a retainer (stopper) 520 fixedly-coupled into the opening of the installation bore 111 of the first connection flow path 100, for retaining the valve plate 510.

The valve plate 510 is composed of: an opening/closing part 511 formed in a domed or hemispherical shape; an extension part (radially extending skirt part) 512 formed circumferentially around the opening/closing part 511, and a plurality of orifices 513 formed through the skirt part 512. The valve plate 510 is formed of a bimetalic material.

The valve plate 510 is mounted in the installation bore 111 of the first connection flow path 100.

The retainer (stopper) 520 has an open center portion 521 therein and is fixedly-coupled in the installation bore 111 of the first connection flow path 100, and retains the valve plate 510 therein.

The opening/closing part 511 of the valve plate 510 is positioned in and thereby closes the first hole 112 of the first connection flow path 100 below a designated temperature. On the other hand, the opening/closing part 511 and the skirt part 512 (forming the valve plate 510) change shape above the designated temperature, and accordingly the opening/closing part 511 is positioned above and thereby opens the first hole 112 of the first connection flow path 100.

Reference symbol P in FIG. 2 indicates a compression pocket in the scroll compressor.

Hereinafter, the operation effect of the apparatus for preventing overheating of a scroll compressor will be explained.

First, the scroll compressor having the apparatus for preventing overheating therein is operated as follows.

When power is applied to the driving motor M of the scroll compressor, the driving motor M is driven and thus a rotation force is generated therefrom. The rotation force of the driving motor M is transferred to the orbiting scroll 50 via the rotating shaft 70. As the rotation force of the rotating shaft 70 is transferred to the orbiting scroll 50, the orbiting scroll 50 coupled to the eccentric portion 72 of the rotating shaft 70 makes an orbiting movement centering on the rotating shaft 70. A rotation of the orbiting scroll 50 is prevented by the Oldham ring 60 and the orbiting scroll 50 thus makes an orbiting movement.

As the orbiting scroll 50 makes the orbiting movement, the wrap 52 of the orbiting scroll 50 engages with the wrap 43 of the fixed scroll 40 during its orbiting movement. Accordingly, a plurality of compression pockets P formed between the wrap 52 of the orbiting scroll 50 and the wrap 43 of the fixed scroll 40 move toward the center of the fixed scroll 40 and the orbiting scroll 50, and simultaneously a volume of the pockets is changed to suck and compress a gas to thereafter discharge it through the discharge hole 41 in the fixed scroll 40.

The refrigerant flows into the casing 10 through the suction pipe 11 and then is sucked into a gap between the fixed scroll 40 and the orbiting scroll 50. Then, the gaseous refrigerant at high temperature and high pressure discharged through the discharge hole 41 of the fixed scroll 40 fills the high pressure space H and flows toward a condenser via the discharge pipe 12.

The refrigerant flowed to the condenser, on the other hand, becomes a fluid while passing through the condenser, and its pressure is reduced while passing through an expansion valve. Afterwards, the refrigerant of low pressure is evaporated while passing through an evaporator. The gaseous refrigerant passed through the evaporator flows into the scroll compressor again.

Figure 4:
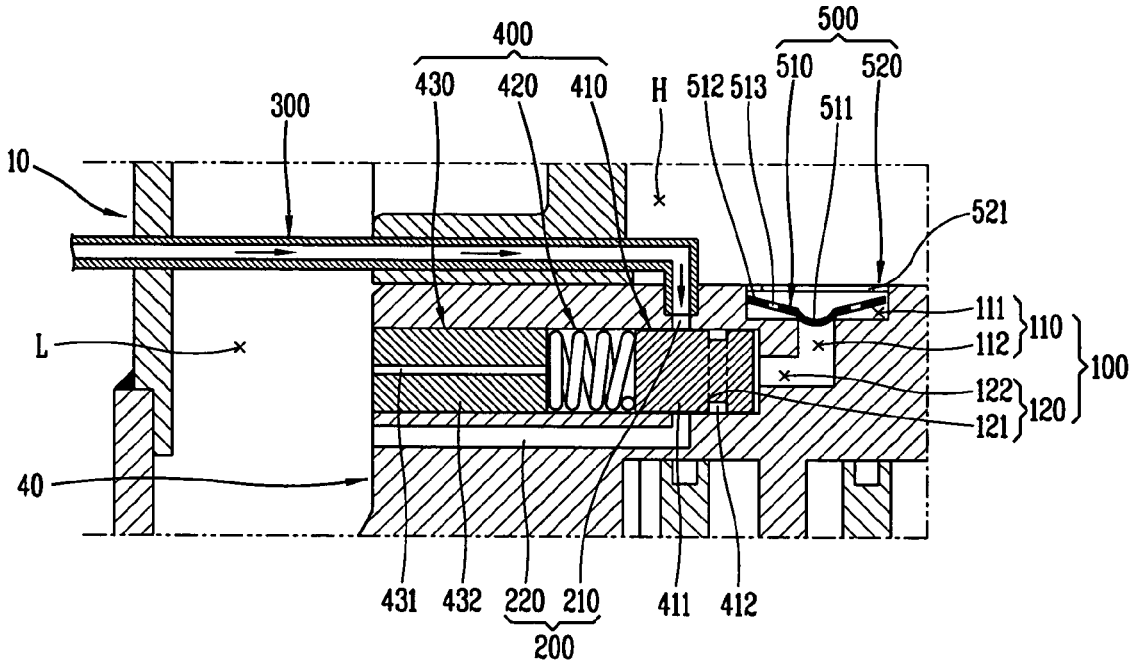
FIGS. 4 and 5 are cross-sectional views respectively showing operation states of the apparatus for preventing overheating of the scroll compressor in accordance with the present invention.

Accordingly, when the scroll compressor is normally driven, as shown in FIG. 4, the high pressure space H inside the cover 90 is maintained within a designated temperature, and thus the valve plate 510 constructing the temperature sensing type valve 500 closes the first connection flow path 100. Because the valve plate 510 closes the first connection flow path 100, pressure of the high pressure space H does not act onto the first connection flow path 100. In response to this, the valve spool 410 constructing the second connection flow path valve 400 is pushed by the elastic force of the spring 420 and then abutted against a step face of the coupling bore 121 and the second hole 122 constructing the second passage 120 of the first connection flow path 100. As a result, the annular groove 412 in the valve spool is not aligned with the third passage 210 of the second connection flow path 200, such that the valve spool 410 closes the third passage 210 of the second connection flow path 200.

As the second connection flow path 200 is closed the fluid refrigerant passed through the condenser of the refrigeration cycle system is prevented from flowing into the second connection flow path 200 through the fluid refrigerant inflow guide pipe 300.

Figure 5:
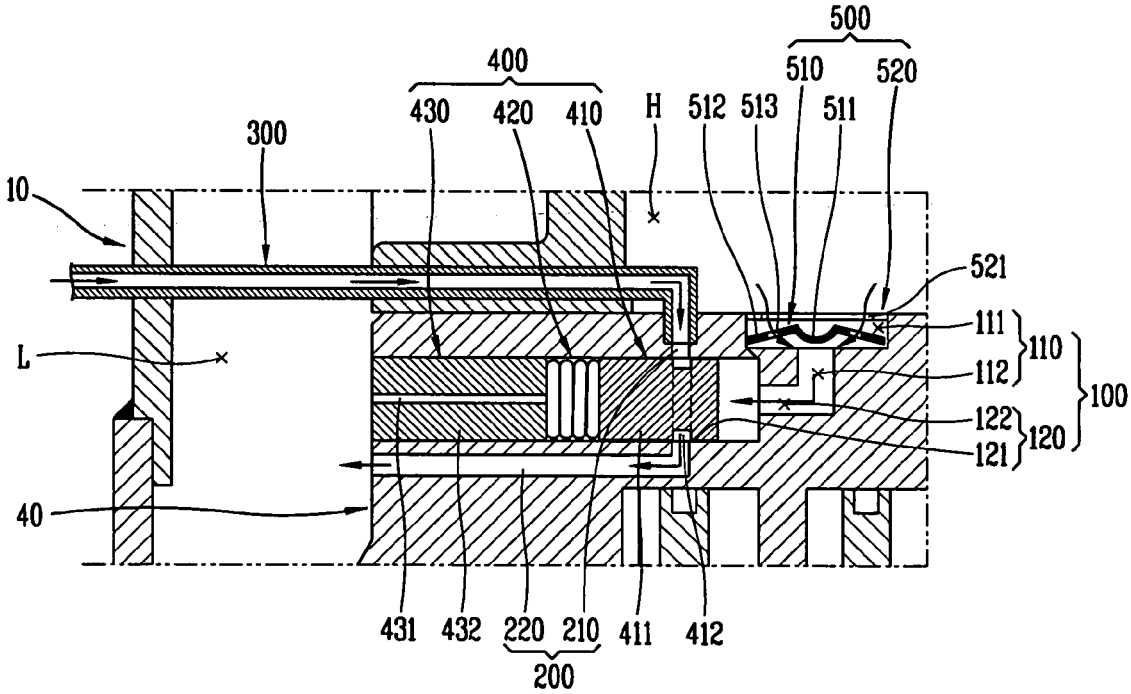

On the other hand, when the temperature in the high pressure space H rises above a designated temperature because the refrigerant in the refrigeration cycle system is not smoothly circulated or there may be a problem in the scroll compressor, then, as shown in FIG. 5, the valve plate 510 of the temperature sensing type valve 500 positioned in the high pressure space H senses the temperature. Accordingly, when the sensed temperature is over the designated temperature, the valve plate 510 is transformed and thus opens the first connection flow path 100.

As the first connection flow path 100 is opened, the high pressure in the high pressure space H acts on the first connection flow path 100, and also acts on the valve spool 410 to thereby push the valve spool 410. At this time, the spring 420 elastically supporting the valve spool 410 is compressed.

As the valve spool 410 is pushed inwardly, the annular groove 412 thereof aligns with the third passage 210 of the second connection flow path 200, and thus the second connection flow path 200 is opened. As a result, a part of the fluid refrigerant passed through the condenser of the refrigeration cycle system moves through the fluid refrigerant inflow guide pipe 300 and the second connection flow path 200 and is thus injected into the low pressure space L through a side surface of the fixed scroll 40.

As the fluid refrigerant is injected into the low pressure space at the side surface of the fixed scroll 40 through the second connection flow path 200, the fluid refrigerant is evaporated so as to cool the low pressure space L in the casing 10 as well as the cover 90 forming the high pressure space H. As the inside of the low pressure space L is cooled, it is possible to lower the temperature of the refrigerant sucked into the compression pocket P which is formed between the fixed scroll 40 and the orbiting scroll 50, and the fluid refrigerant is injected into the high pressure space H defined by the cover 90 to thereby cool the high pressure space H.

As the inside of the high pressure space H is cooled, the valve plate 510 senses the temperature. When the sensed temperature then becomes less than the designated temperature, the shape of valve plate 510 is transformed to its original state to close the first hole 112 of the first connection flow path 100. As the first connection flow path 100 is closed, and thus the high pressure acting on the first connection flow path 100 is also cut off, the valve spool 410 is slid by the elastic force of the spring 420 and is then abutted at the step face formed by the coupling bore 121 and the second hole 122. As a result, the third passage 210 is closed by the valve spool 410, and accordingly the second connection flow path 200 is closed, whereby the fluid refrigerant is prevented from flowing into the fluid refrigerant inflow guide pipe 300.

As described above, in the apparatus for preventing overheating of the scroll compressor according to the present invention, while the scroll compressor operates, when a temperature of the high temperature portion of the scroll compressor is risen over the designated temperature due to abnormality of the scroll compressor or the refrigeration cycle system, the temperature is sensed to open/close the connection flow path, whereby a part of the fluid refrigerant of the refrigeration cycle system is injected into the casing to lower the temperature of the high temperature portion. As a result, by preventing overheating of the scroll compressor in its operation, it is effective to prevent a breakdown of components and improve reliability of the compressor.

Furthermore, there need not be installed a separate temperature sensor for sensing the temperature nor a separate control circuit for controlling a valve which controls injection of fluid refrigerant, and accordingly the construction of the compressor is more simplified to reduce the manufacturing costs therefor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for preventing overheating of a scroll compressor in which an orbiting scroll engaging with a fixed scroll in a casing makes an orbiting movement to compress a gas, the apparatus comprising:

a first connection flow path for communicating a high pressure space and a low pressure space in the casing;

a second connection flow path for communicating the first connection flow path and the low pressure space in the casing;

a fluid refrigerant inflow guide pipe for guiding fluid refrigerant from a refrigeration cycle system to flow into the low pressure space via the second connection flow path by connecting the refrigeration cycle system with the second connection flow path;

a second connection flow path valve coupled to an inside of the first connection flow path, for opening/closing the second connection flow path in accordance with a pressure difference between the low pressure space and the high pressure space; and a temperature sensing type valve coupled to an inside of the first connection flow path, for opening/closing the first connection flow path according to a temperature in the high pressure space, wherein the second connection flow path valve comprises:

a valve spool slidable along a bore of the first connection flow path, for opening/closing the second connection flow path, and wherein the temperature sensing type valve is configured to open the first connection flow path when the temperature in the high pressure space exceeds a predetermined temperature such that a high pressure in the high pressure space pushes the valve spool along the bore of the first connection flow path to align a flow path in the valve spool with the fluid refrigerant inflow guide pipe and open the second communication flow path.

2. The apparatus of claim 1, wherein the first connection flow path is communicated with an outer surface of the fixed scroll located in the high pressure space and a side surface of the fixed scroll located in the low pressure space.

3. The apparatus of claim 1, wherein the first connection flow path comprises:

a first passage extending with a certain depth inwardly from the outer surface of the fixed scroll and communicating with the high pressure space; and a second passage communicating the side surface of the fixed scroll located in the low pressure space with the first passage.

4. The apparatus of claim 3, wherein the first passage comprises:

an installation bore formed in the outer surface of the fixed scroll; and a first hole formed with an inside diameter smaller than that of the installation bore, extending inwardly from the installation bore and connected to the second passage.

5. The apparatus of claim 3, wherein the second passage comprises:

a coupling bore formed in a side surface of the fixed scroll; and a second hole formed with an inside diameter smaller than that of the coupling bore, extending inwardly from the coupling bore, and connected to the first passage.

6. The apparatus of claim 1, wherein the second connection flow path comprises:

a third passage formed in the fixed scroll and intersecting with the first connection flow path; and a fourth passage formed in the fixed scroll, for communicating a side surface of the fixed scroll and the third passage.

7. The apparatus of claim 1, wherein the fluid refrigerant inflow guide pipe is connected to the third passage.

8. The apparatus of claim 6, wherein the third passage is formed perpendicular to the first connection flow path.

9. The apparatus of claim 1, wherein the second connection flow path valve further comprises:

the valve spool slidable along the bore of the first connection flow path, for opening/closing the second connection flow path;

a spring urging the valve spool towards a closed position; and a supporting member having a through hole therein and press-fit in the first connection flow path behind the spring, for supporting the spring.

10. The apparatus of claim 9, wherein the valve spool comprises:

a cylindrical body; and an annular groove formed in an outer circumferential surface of the cylindrical body.

11. The apparatus of claim 1, wherein the temperature sensing type valve comprises:

a diaphragm inserted into the first connection flow path and able to be transformed in shape according to the temperature of the high pressure space for thus opening/closing the first connection flow path; and a retainer for retaining the diaphragm in the first connection flow path.

12. The apparatus of claim 11, wherein the diaphragm comprises:

a central domed opening/closing part formed with a hemispherical shape;

a skirt portion extending radially at an outer circumferential surface of the opening/closing part; and a plurality of holes penetratively-formed through the skirt portion.

* * * * *